US007261645B2

(12) United States Patent
Oyama

(10) Patent No.: US 7,261,645 B2
(45) Date of Patent: Aug. 28, 2007

(54) GOLF CLUB HEAD

(75) Inventor: Hitoshi Oyama, Kobe (JP)

(73) Assignee: SRI Sports Limited, Kobe-shi, Hyogo-Ken (JP)

( * ) Notice: Subject to any disclaimer, the term of this patent is extended or adjusted under 35 U.S.C. 154(b) by 273 days.

(21) Appl. No.: 11/050,774

(22) Filed: Feb. 7, 2005

(65) Prior Publication Data

US 2005/0215352 A1 Sep. 29, 2005

(30) Foreign Application Priority Data

Mar. 23, 2004 (JP) ..... 2004-085227

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

U.S. PATENT DOCUMENTS

| | | | | |
|---|---|---|---|---|
| 5,377,986 | A * | 1/1995 | Viollaz et al. | 473/330 |
| 5,425,538 | A * | 6/1995 | Vincent et al. | 473/342 |
| 5,624,331 | A * | 4/1997 | Lo et al. | 473/345 |
| 6,406,378 | B1 * | 6/2002 | Murphy et al. | 473/224 |
| 6,849,003 | B2 * | 2/2005 | Kumamoto | 473/305 |
| 6,929,565 | B2 * | 8/2005 | Nakahara et al. | 473/345 |
| 2004/0116207 | A1 * | 6/2004 | De Shiell et al. | 473/345 |
| 2004/0192468 | A1 * | 9/2004 | Onoda et al. | 473/345 |
| 2005/0026723 | A1 * | 2/2005 | Kumamoto | 473/345 |
| 2005/0245328 | A1 * | 11/2005 | Kouno et al. | 473/345 |

FOREIGN PATENT DOCUMENTS

JP 2003-250933 A 9/2003

* cited by examiner

*Primary Examiner*—Sebastiano Passaniti
(74) *Attorney, Agent, or Firm*—Birch, Stewart, Kolasch & Birch, LLP

(57) ABSTRACT

A hollow golf club head comprises:

a metal member made of at least one kind of metal material having at least one opening in a crown portion thereof; and a FRP member made of a fiber reinforced resin attached to the metal member so as to cover the opening, the fiber reinforced resin formed from a plurality of prepreg plies each having a magnitude covering the opening, and the prepreg plies comprising a plurality of unidirectional plies each having fibers aligned along an unidirection, wherein the unidirectional plies comprise at least "n" kinds of (in this case, "n" is an integral number not less than 3 and not more than 6) plies which are laminated in a state in which directions of the fibers are differentiated, and in a standard condition of being grounded on a horizontal plane at prescribed lie angle and loft angle, the directions of the fibers of the "n" kind of unidirectional plies seeing through a plane intersect at an angle (180/n) degrees obtained by substantially dividing 180 degrees by the integral number n in the crown portion.

11 Claims, 13 Drawing Sheets

GOLF CLUB HEAD

BACKGROUND OF THE INVENTION

1. Field of the Invention

The present invention relates to a golf club head, more particularly to a joint structure of a metal member made of a metal material and a FRP member made of a fiber reinforced resin.

2. Description of the Related Art

The laid open Japanese patent application JP-P2003-250933A discloses a hollow golf club head "a" composed of a metal member b made of a metal material and a FRP member c made of a fiber reinforced resin, as shown in FIG. 15. The metal member b has an opening d, and the FRP member c is attached to the metal member b and covers the opening d. This head "a" can save the weight thereof on the basis of the small specific gravity of the resin. Further, the saved weight can be allocated, for example, in the sole portion or the like, and can improve degree of freedom in the weight allocation design or the like.

The FRP member c is generally made of a plurality of prepreg plies e, as shown in FIGS. 16(A) to 16(C). FIGS. 16(A) and 16(B) each is a plan view showing an example of unidirectional prepreg ply e1 (which are called also as "UD prepreg" in the industry). The ply e1 comprises reinforcing fibers "f" aligned along unidirection in a matrix resin R thereof. FIG. 16(C) is a plan view showing a cloth prepreg ply e2. The ply e2 comprises a woven fabric having fibers extending in two directions and intersecting each other, in a matrix resin R. Further, the FRP member c is made by laminating a plurality of prepreg plies e which are previously preformed in a predetermined shape, and curing in a predetermined shape under heat and pressure.

In the conventional FRP member c, a 0° direction prepreg ply e1*a* having a fiber orientation of 0 degree with respect to the head longitudinal direction BL, as shown in FIG. 16(A), and a 90° direction prepreg ply e1*b* having a fiber orientation of 90 degrees with respect to the head longitudinal direction BL, as shown in FIG. 16(B) are used in a state in which the same number of them (for example, two) are laminated. In a laminated structure of the plies mentioned above, a strength can be secured by arranging the directions of the fibers f in the head longitudinal direction corresponding to a direction in which an impact force is directly applied at a time of striking a ball, and a direction perpendicular thereto. Further, there is a case that one cloth prepreg ply e2 is further attached to an outer side.

However, in the conventional FRP member c, a deformation at a time of striking the ball is larger in comparison with the metal material, and an energy loss is larger. Accordingly, a kinetic energy of the head is not efficiently transmitted to the ball. Therefore, in order to improve a carry, it is necessary to further improve the FRP member c.

SUMMARY OF THE INVENTION

The present invention is made by taking the problem mentioned above into consideration, and an object of the present invention is to provide a golf club head which serves for making a FRP member hard to be deflected by an external force from various directions, and inhibiting an energy loss so as to increase a carry.

In accordance with the present invention a hollow golf club head comprises:

a metal member made of at least one kind of metal material having at least one opening in a crown portion thereof; and a FRP member made of a fiber reinforced resin attached to the metal member so as to cover the opening, the fiber reinforced resin formed from a plurality of prepreg plies each having a magnitude covering the opening, and the prepreg plies comprising a plurality of unidirectional plies each having fibers aligned along an unidirection, wherein the unidirectional plies comprise at least "n" kinds of (in this case, "n" is an integral number not less than 3 and not more than 6) first to n-th plies which are laminated in a state in which directions of the fibers are differentiated, and in a standard condition of being grounded on a horizontal plane at prescribed lie angle and loft angle, the directions of the fibers of the first to n-th unidirectional plies seeing through a plane intersect at an angle (180/n) degrees obtained by substantially dividing 180 degrees by the integral number n in the crown portion.

Since a deforming mode on the hollow golf club head at a time of striking a ball is very complex, the FRP member is exposed to the external force from various directions within the plane. However, the FRP member used in the present invention is hard to be deflected with respect to the external force from the various directions. Accordingly, the deforming amount of the FRP member at a time of striking the ball becomes small, and the energy loss is small. Therefore, the head according to the present invention can efficiently transmit the kinetic energy to the ball. Accordingly, the carry of the struck ball is increased.

DESCRIPTION OF THE PREFERRED EMBODIMENTS

Figure 1:
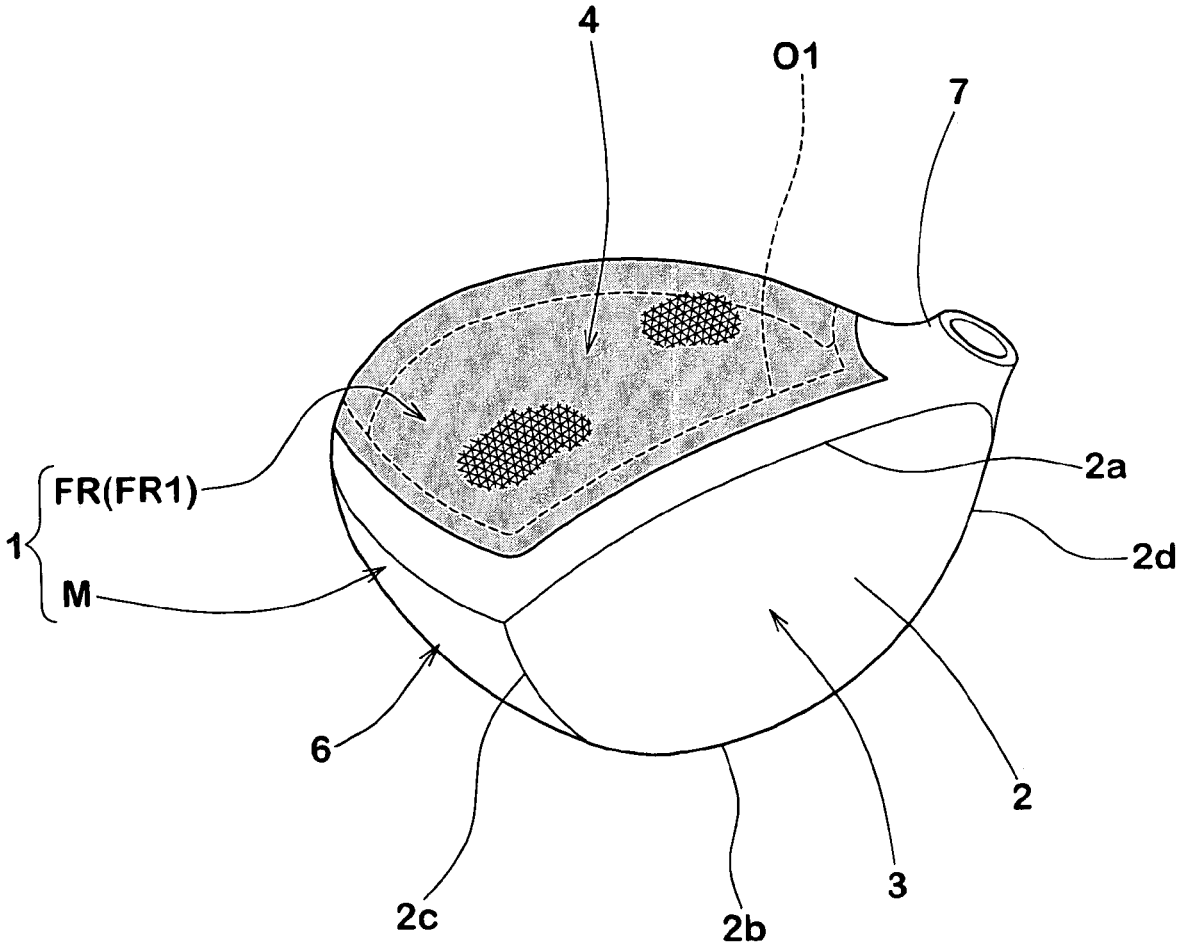
FIG. 1 is a perspective view of a wood-type golf club head according to the present invention.

Embodiments of the present invention will now be described in detail in conjunction with the accompanying drawings.

FIGS. 1 to 4 show a standard condition in which a golf club head 1 according to the present embodiment is grounded on a horizontal plane HP at a prescribed lie angle and loft angle. In the drawings, the head 1 according to the present invention is a wood-type club head such as #1 driver and fairway wood. The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a neck portion 7 to be attached to an end of a club shaft (not shown).

The head 1 comprises a metal member M, and a FRP member FR attached to the metal member M.

The FRP member FR according to the present embodiment is exemplified by a crown side FRP member FR1 structuring at least a part of the crown portion 4. The FRP member FR1 is a composite material composed of a matrix resin and a reinforcing fiber. The composite material has a smaller specific gravity in comparison with the metal material. Accordingly, the head 1 according to the present embodiment can obtain a comparatively great weight saving effect in the crown portion 4. The saved weight is consumed for enlarging a size of the metal member M or is allocated to a proper portion of the metal member M, for example. Accordingly, it serves for improving a freedom of designing a weight allocation of the head 1. Further, in the case that the FRP member FR is provided in the crown portion as in the present embodiment, a gravity point of the head becomes lower.

The matrix resin mentioned above is not particularly limited, however, there can be listed up, for example, a thermosetting resin such as an epoxy resin, a phenol resin and unsaturated polyester resin; and a thermoplastic resin such as a polycarbonate resin and a nylon resin. The former matrix resin is preferable in a point that it is inexpensive, has an improved adhesive property with the fiber and has a comparatively short forming time. Further, the fiber is not particularly limited, however, can employ a carbon fiber; a glass fiber; an organic fiber such as an aramid fiber, a polyphenylene benzoxazole resin fiber (PBO fiber) or the like; and a metal fiber such as an amorphous fiber, a titanium fiber or the like. Especially, the carbon fiber having a small specific gravity and a large tensile strength is preferable.

Further, an elastic modulus of the fiber is not particularly limited, however, if it is too small, it is impossible to secure a rigidity of the FRP member FR and a durability tends to be lowered, and if it is inversely too large, a cost thereof is increased, and the tensile strength tends to be lowered. From this point of view, it is desired that the elastic modulus of the fiber is not less than 50 GPa, more preferably not less than 100 GPa, further preferably not less than 150 GPa, and particularly further preferably not less than 200 GPa. Further, it is desirable that an upper limit is preferably not more than 450 GPa, more preferably not more than 350 GPa, and further preferably not more than 300 GPa.

In this case, the elastic modulus of the fiber corresponds to an elastic modulus in tension, and is constituted by a value measured according to "carbon fiber test method" in JIS R7601. Further, in the case that two or more kinds of fibers are contained, there is employed an average elastic modulus obtained by calculating the elastic modulus of each of the fibers by weighing on the basis of a weight ratio, as shown by the following expression.

Average elastic modulus $$=\Sigma(Ei\cdot Vi)/\Sigma Vi(i=1,2,\ldots)$$

(wherein "Ei" denotes an elastic modulus of a fiber i, and "Vi" denotes a total weight of the fiber i)

Figure 2:
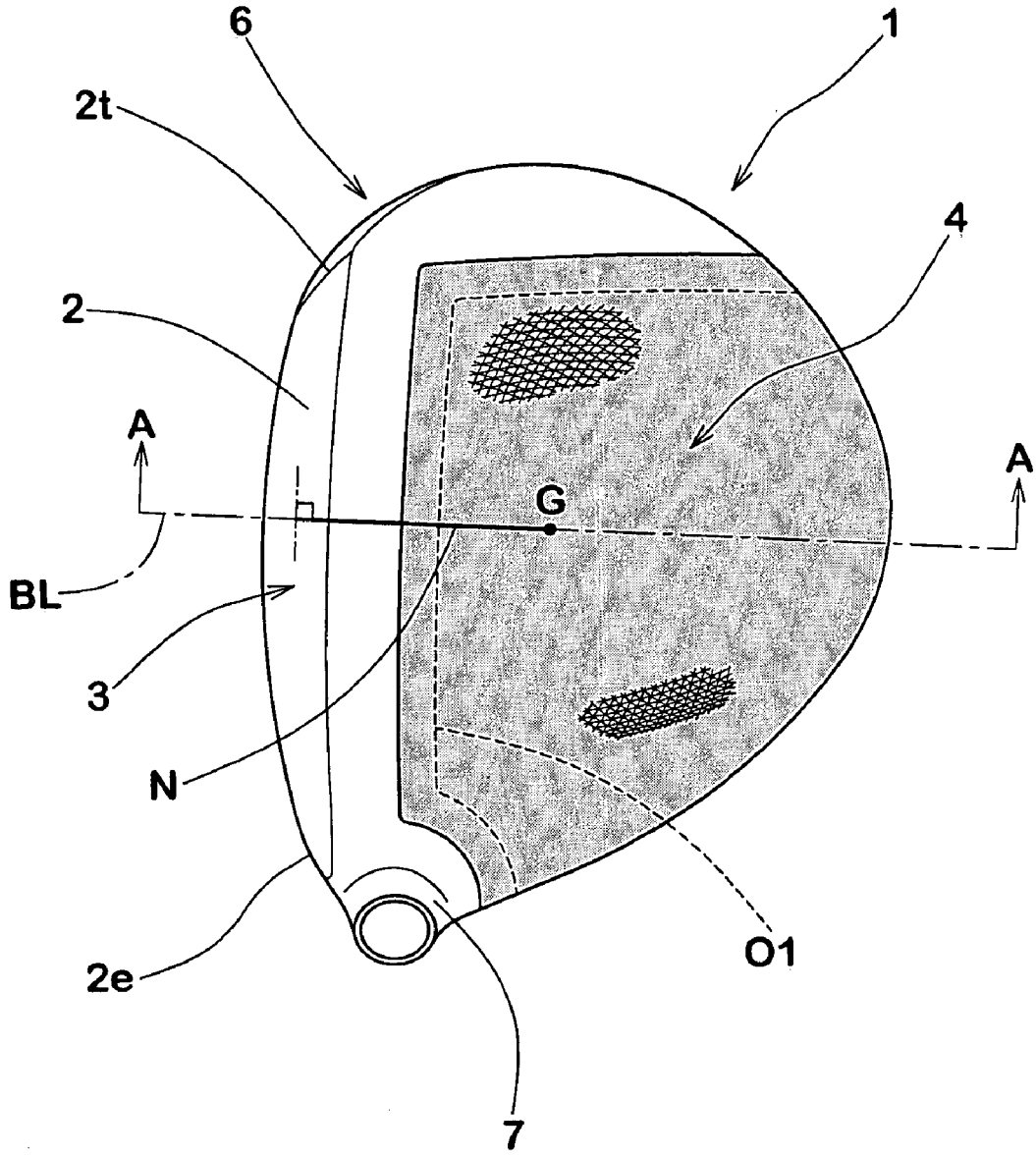
FIG. 2 is a plan view thereof.
Figure 3:
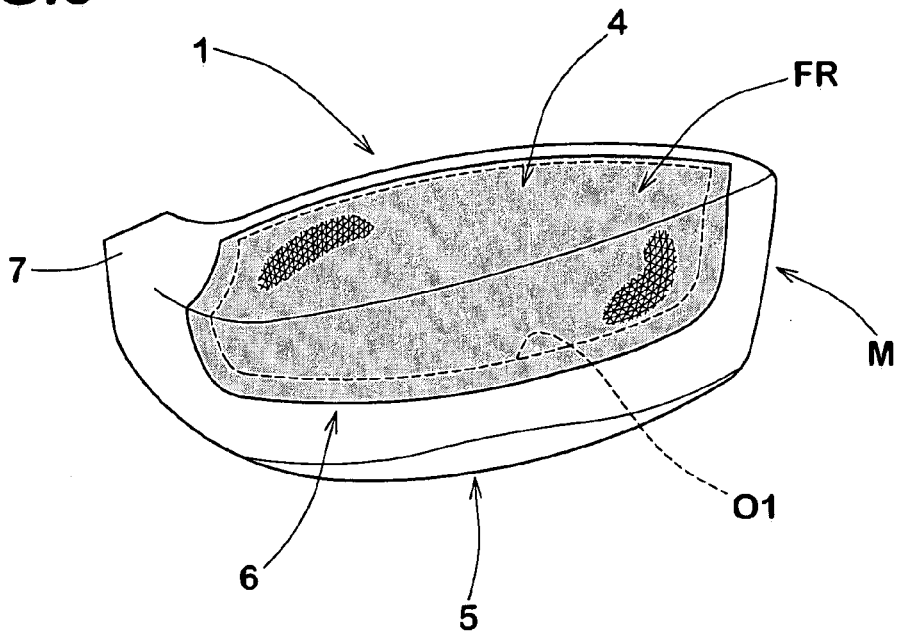
FIG. 3 is a back view thereof.
Figure 4:
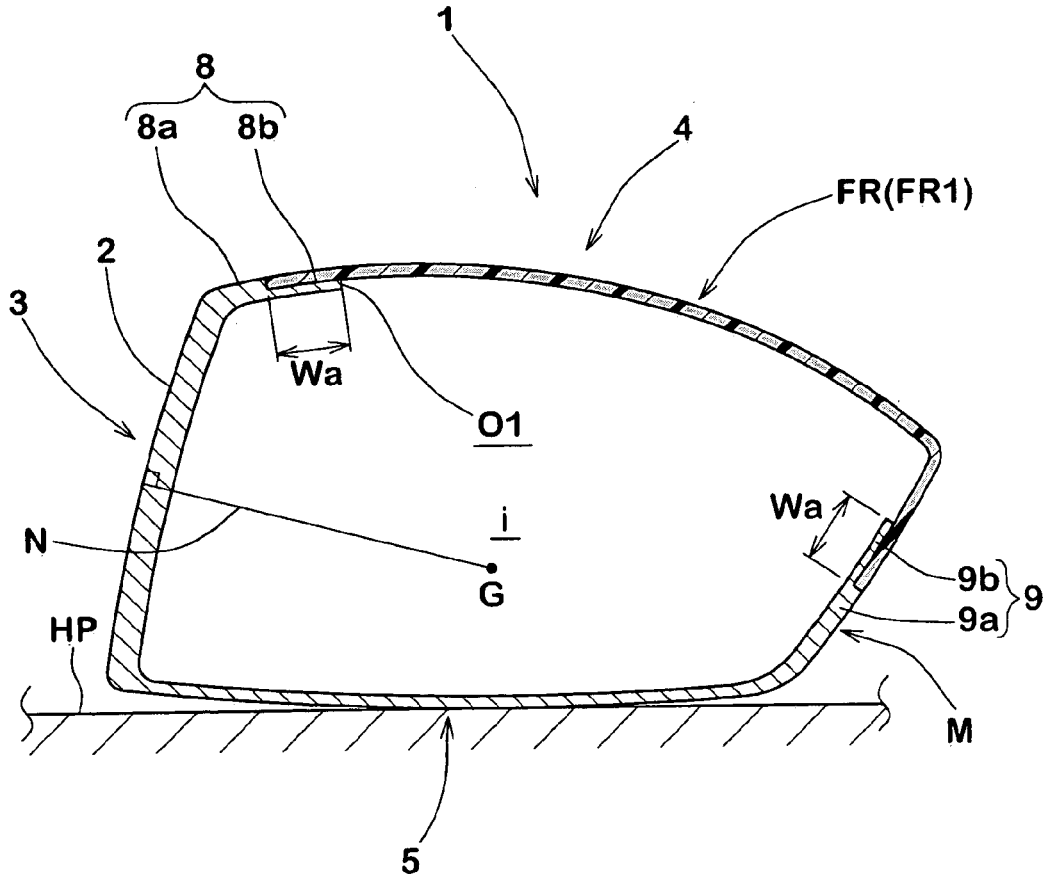
FIG. 4 is a cross sectional view taken on line A-A in FIG. 2.

Further, in the metal member M, for example, at least one opening O1 is provided of the crown portion 4. The opening O1 is provided astride the crown portion 4 and the side portion 6, as shown in FIG. 4. The opening O1 has a profile shape including a head gravity point G in a plan view in the standard condition, as shown in FIG. 2. Further, the opening O1 may be structured, for example, such as to be stopped only by the crown portion 4 without being astride the side portion 6.

Figure 5:
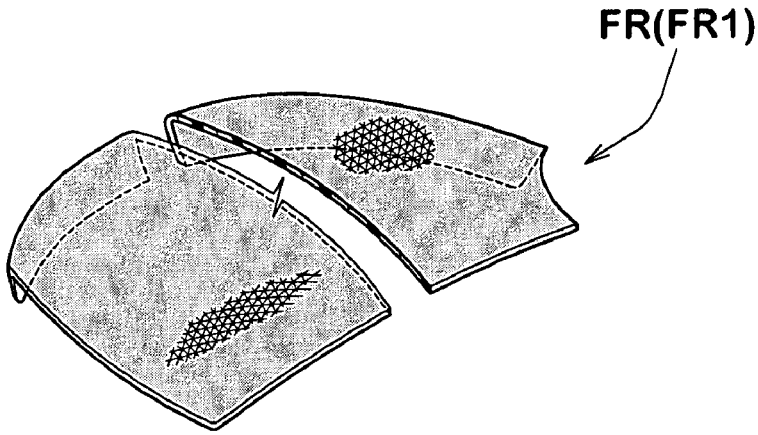
FIG. 5 is an exploded perspective view showing a metal member and a FRP member.
Figure 5:
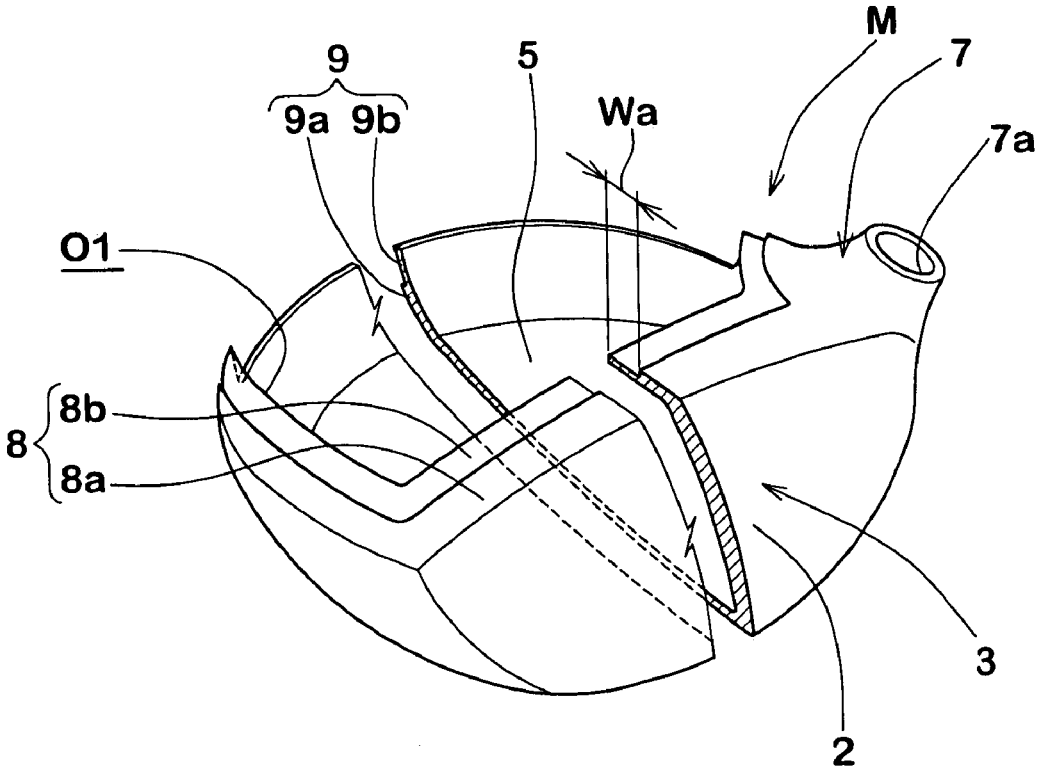

The metal member M according to the present embodiment comprises, as shown in FIG. 5, the face portion 3; the sole portion 5; the neck portion 7; a crown edge portion 8 provided around the opening O1 in the crown portion 4; and a side main portion 9 forming at least one part of the side portion 6. The metal member M according to this embodiment is integrally formed in each of the portions by casting. Further, according to another embodiment, the metal member M is formed by forming two or more parts according to a working method such as forging, casting, pressing or rolling and thereafter integrally bonding them according to a welding or the like. Further, the metal material forming the metal member M is not particularly limited, however, can employ, for example, a stainless steel, a maraging steel, a titanium, a titanium alloy, an aluminum alloy, a magnesium alloy, an amorphous alloy or the like. Especially, a titanium alloy, an aluminum alloy or a magnesium alloy, having a large specific strength, is desirable. Further, the metal member M may be formed by using two or more kinds of metal materials, without being limited to be formed by one metal material. In the present embodiment, the titanium alloy is employed as the metal member M.

Further, as shown in FIGS. 4 and 5, the crown edge portion 8 includes a crown surface portion 8*a* forming an outer surface portion of the crown portion 4 and extending around the opening O1, and a crown receiving portion 8*b* extending along the crown surface portion 8*a*, having a step from the crown surface portion 8*a* in a surface and depressed to a side of the hollow portion i. In the same manner, the side main portion 9 includes a side surface portion 9*a* forming an outer surface portion of the side portion 6 and extending around the opening O1 in the side portion 6, and a side receiving portion 9*b* extending along the side surface portion 9*a*, having a step from the side surface portion 9*a* in a surface and depressed to a side of the hollow portion i.

According to the present embodiment, the crown receiving portion 8*b* and the side receiving portion 9*b* are connected to each other, whereby an annular receiving portion is formed around the opening O1. Each of the receiving portions 8*b* and 9*b* can hold an inner surface of the crown side FRP member FR1 and a peripheral edge portion thereof. Further, each of the receiving portions 8*b* and 9*b* serves for finishing the surface of the FRP member FR1 on the side of the crown flush with the crown surface portion 8*a* and the side surface portion 9*a*.

Each of the receiving portions 8*b* and 9*b* and the crown side FRP member FR1 are bonded therebetween. The receiving portions 8*b* and 9*b* according to the present embodiment are connected to each other, thereby being continuously and annularly provided in the entire periphery around the opening O1, however, may be partly interrupted. According to a preferable aspect, it is desirable that each of the receiving portions 8*b* and 9*b* is formed at a length not less than 50% of an opening length L along the opening O1, more preferably not less than 60%, and further preferably not less than 70%. Accordingly, it is possible to sufficiently secure a bonding area between the crown side FRP member FR1 and the metal member M, and it is possible to obtain a larger adhesive strength.

Further, a width Wa of each of the receiving portions 8*b* and 9*b* measured in a perpendicular direction from an edge of the opening O1 is not particularly limited, however, if it is too small, the bonding area between the metal member M and the crown side FRP member FR1 becomes small, whereby a bonding strength tends to be lowered, and if it is inversely too large, the area of the opening O1 can not be sufficiently secured, whereby there is a case that the weight saving effect can not be sufficiently obtained. From this point of view, it is desirable that the width Wa is, for example, not less than 5 mm, and preferably not less than 10 mm, and it is desirable that the upper limit is not more than 30 mm, more preferably not more than 20 mm, and particularly preferably not more than 15 mm. In this case, the width Wa may be fixed, or may be changed in each of the portions.

The crown side FRP member FR1 forms a part of the crown portion 4, and a part of the side portion 6 in the present embodiment. In other words, it is not necessary that the crown side FRP member FR1 forms an entire of the crown portion 4, but it is sufficient that it forms at least a part thereof. However, if the area of the crown side FRP member FR1 (in other words, the opening O1) is too small, there is a tendency that a sufficient weight saving effect can not be obtained in the head 1.

From this point of view, it is desirable that a ratio (S1/S) between the entire surface area S (measured in a state of filling a shaft insertion hole 7*a* of the neck portion 7) of the head, and a surface area S1 of a portion covering the opening O1 of the FRP member FR (not including an adhered portion between the receiving portions 8*b* and 9*b*) is preferably not less than 0.10, more preferably not less than 0.20, and further preferably not less than 0.30. On the other hand, if the ratio (S1/S) is too large, there is a tendency that a productivity is deteriorated, a head rigidity and strength are lowered, or a gravity point of the head becomes high, so that it is desirable that it is preferably not more than 0.60, more preferably not more than 0.50, and further preferably not more than 0.45.

Figure 6:
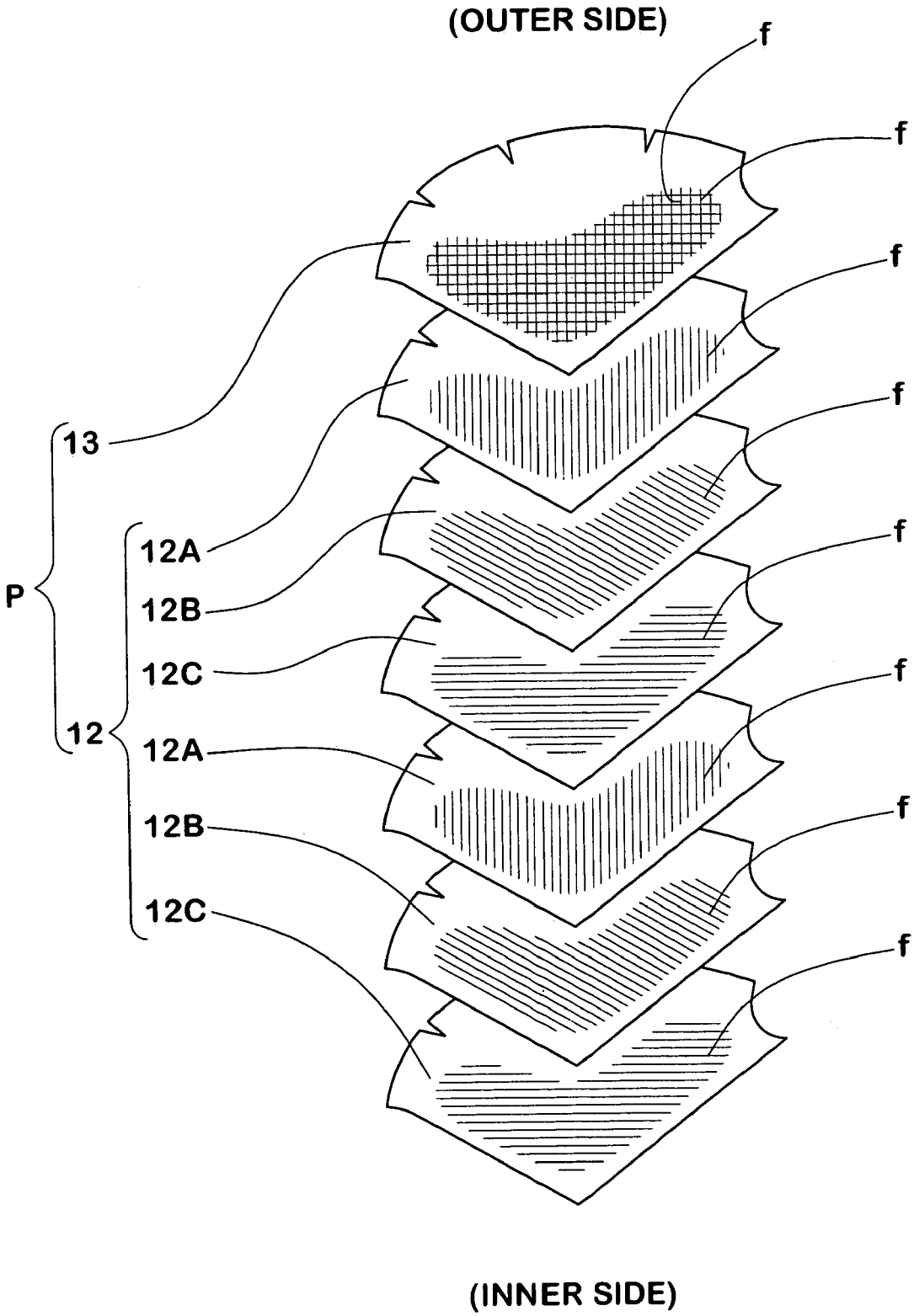
FIG. 6 is an exploded perspective view showing a plurality of prepreg plies.

Further, the FRP member FR is formed from a laminated body P comprising a plurality of prepreg plies, as shown in FIG. 6. The prepreg plies comprise a plurality of (six in this example) unidirectional plies 12 each having a magnitude capable of covering the opening O1, and one cloth ply 13 arranged on an outermost side.

Figure 7A:
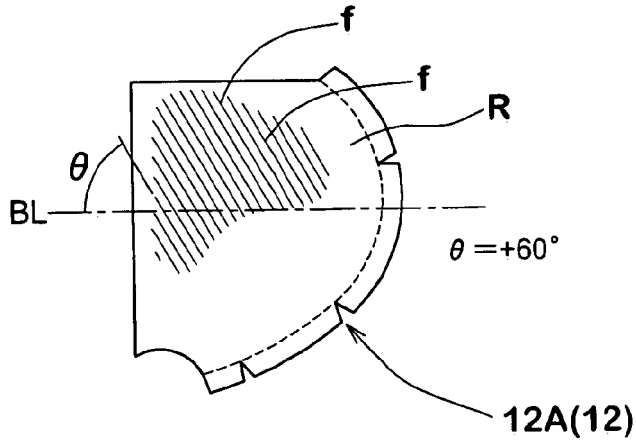
FIGS. 7(A) to 7 (C) are plan views showing an example of aUD.tional prepreg ply.
Figure 7B:
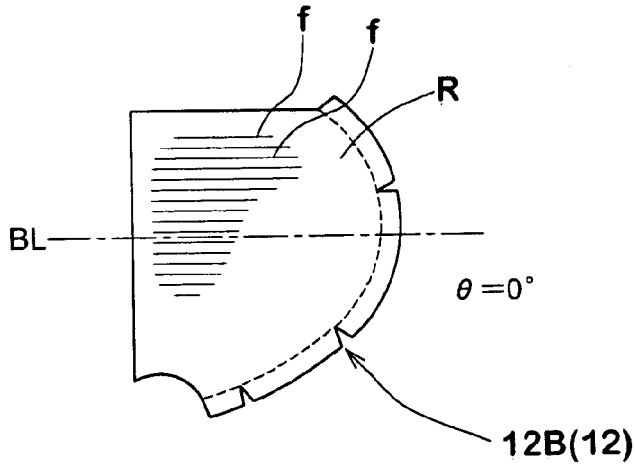
Figure 7C:
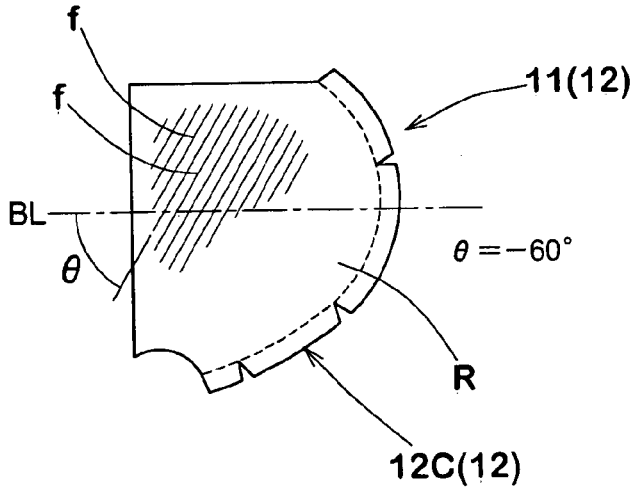
Figure 8:
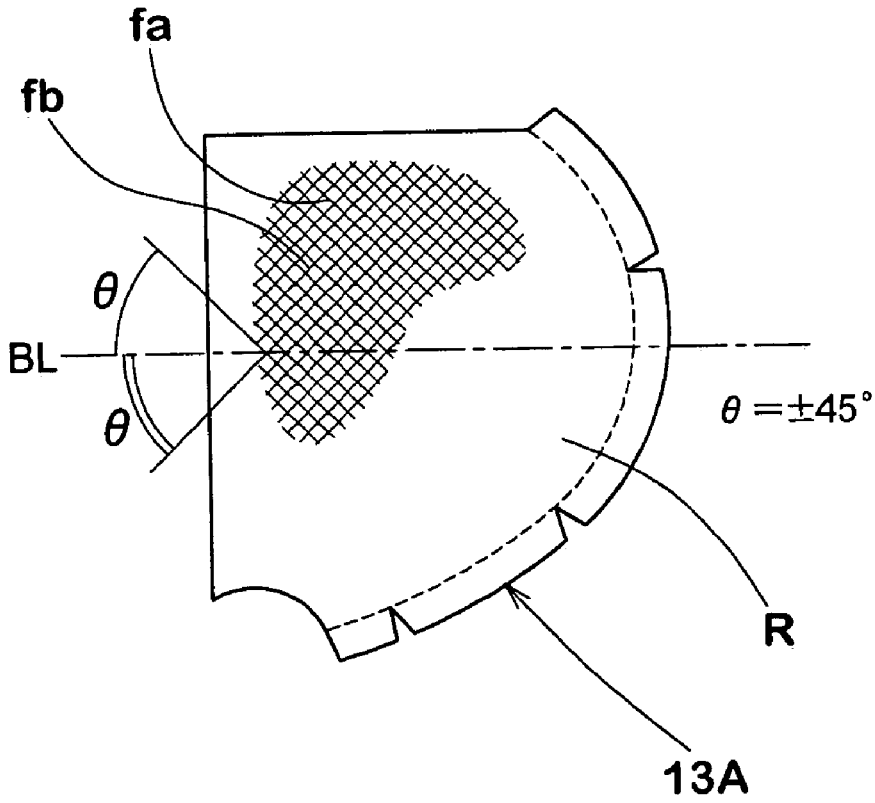
FIG. 8 is a plan view showing an example of a cloth prepreg ply.

Further, FIGS. 7(A) to 7(C) show plan views of the unidirectional ply 12, and FIG. 8 shows a plan view of the cloth ply 13.

The unidirectional ply 12 is a non-cured or semi-cured sheet body comprising an array body of the fibers f aligned along unidirection impregnated with the matrix resin R. The term "unidirection" means that the fibers f are aligned in a substantially single direction with respect to each ply. The unidirectional ply 12 shown in FIGS. 7(A) to 7(C) has the fibers f aligned in different directions with respect to a head longitudinal direction BL. On the other hand, the cloth ply 13 shown in FIG. 8 has fibers fa and fb which are aligned in two directions in the ply and intersect to each other. Each of the fibers fa and fb is previously woven as a woven fabric.

In the present invention, the unidirectional plies 12 comprise at least "n" kinds of first to n-th plies which are laminated in a state in which the direction of the fiber f is differentiated. In this case, the "n" mentioned above is an integral number which is not less than 3 and not more than 6. In other words, the unidirectional plies 12 comprise three to six kinds in which the directions of the fibers f are different.

Further, in the standard condition, the directions of the fibers of the first to "n" th unidirectional plies seeing through from the plane intersect substantially at an angle (180/n) degrees obtained by dividing 180 degrees by the "n", in the crown portion 4. If the kind number becomes equal to or more than seven, the productivity tends to be deteriorated. It is desirable that the kind number n of the unidirectional ply is preferably not more than five, an more preferably three to four. A description will be in detail given below of a particular embodiment in which "n" is set to three.

The unidirectional plies 12 according to the present embodiment comprise three kinds of first to third plies 12A, 12B and 12C laminated in a state in which the directions of the fibers f are differentiated.

As shown in FIG. 7(A), the first ply 12A has the fibers f having a fiber orientation of substantially 60 degrees with respect to the head longitudinal direction BL. Further, as shown in FIG. 7(B), the second ply 12B has the fibers f having a fiber orientation of substantially 0 degree with respect to the line BL. Further, as shown in FIG. 7(C), the third ply 12C has the fibers f having a fiber orientation of substantially −60 degrees with respect to the direction BL. Each of the first to third ply comprises two plies, as shown in FIG. 6.

In this case, an angle θ of the fiber orientation with respect to the head longitudinal direction BL is expressed by setting a clockwise direction to a positive direction in FIG. 7.

Further, "head longitudinal direction" BL mentioned above is a direction extending along a perpendicular line N drawn from a head gravity point G to the club face 2, in a plan view (FIG. 2) in the standard condition. For example, the 0 degree direction ply 12B is not necessarily structured such that the fibers f strictly form 0 degree with respect to the head longitudinal direction BL, but may include a dispersion of at least −10 degrees to +10 degrees (that is, plus minus 10 degrees) with respect to a nominal angle β (0 degree in this case) of the angle, and more preferably −5 degrees to +5 degrees (that is, plus minus 5 degrees).

According to the present embodiment, all the carbon fibers of the first to third plies 12A to 12C have the same elastic modulus in tension. Further, each of the ply 12A to 12C has a same fiber weight per unit area and same resin material. The prepreg plies 12A to 12C mentioned above can be easily prepared, for example, by punching by means of a cutting die or the like such that the angle of the fiber f from a long and wide prepreg base sheet (not shown) to the head longitudinal direction forms +60°, 0° and −60°. Accordingly, it is possible to prepare three kinds of unidirectional plies 12A to 12B from one kind of prepreg base sheet, and an excellent productivity is provided.

Further, it is desirable that the fibers f of the unidirectional plies 12 are allocated in parallel by setting a bundle body obtained by previously bundling a plurality of filaments to a unit. The filament number included in the bundle body is not particularly limited, however, if it is too little, it is necessary to increase the number of the prepreg for obtaining a necessary strength, so that a cost and a productivity are deteriorated. On the contrary, if the filament number is too much, a formability is deteriorated. From this point of view, it is desirable that the filament number is preferably not less than 6 K ("1 K" means 1000 filaments, and 6 K means 6000 filaments), more preferably not less than 10 K, further preferably not less than 12 K. Further, it is desirable that an upper limit thereof is preferably not more than 40 K, more preferably not more than 30 K, and further preferably not more than 24 K.

Further, a profile shape of each of the ply 12A to 12C is appropriately set in correspondence to the shape of the opening O1. In this example, the back face side of the prepreg is folded to the side portion 6. Accordingly, in order to make it easy to fold, each ply 12A to 12C is provided with one or more slits. In each of the ply 12A to 12C, a direction at a time of being arranged in the opening O1 is defined. Accordingly, the angle θ of the fiber orientation in each of the ply 12A to 12C with respect to the head longitudinal direction BL is determined in a state of being aligned with the direction.

Figure 9A:
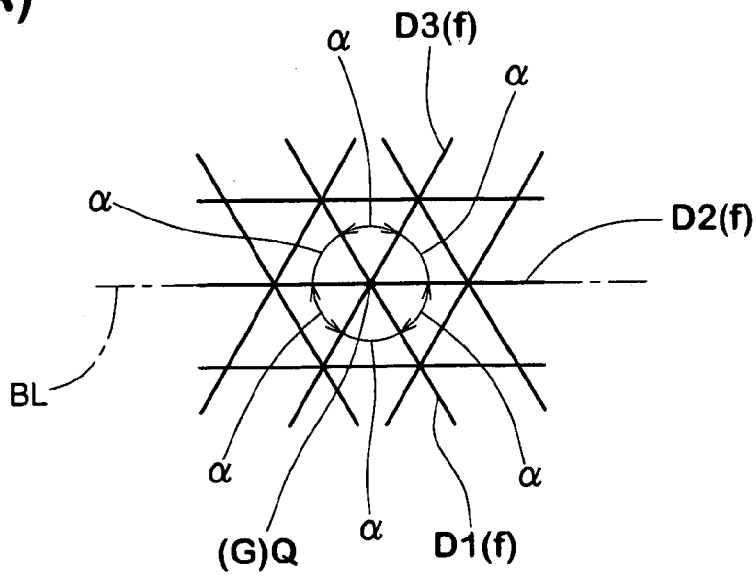
FIGS. 9(A) and 9(B) are schematic views showing a direction of fibers of the first to third unidirectional prepreg plies.

FIG. 9(A) shows the directions of the fibers f of the first to third plies 12A, 12B and 12C in the crown portion 4 seeing through from the plane (FIG. 2) under the standard condition. In the drawing, the directions of the fibers f of the first to third plies 12A, 12B and 12C are shown by reference symbols D1, D2 and D3, respectively. In this embodiment, the directions D1, D2 and D3 intersect substantially at an angle α of 60 degrees on one intersection Q thereof. This angle α equals to a value obtained by dividing 180 degrees by the kind number 3 of the unidirectional plies.

Figure 9B:
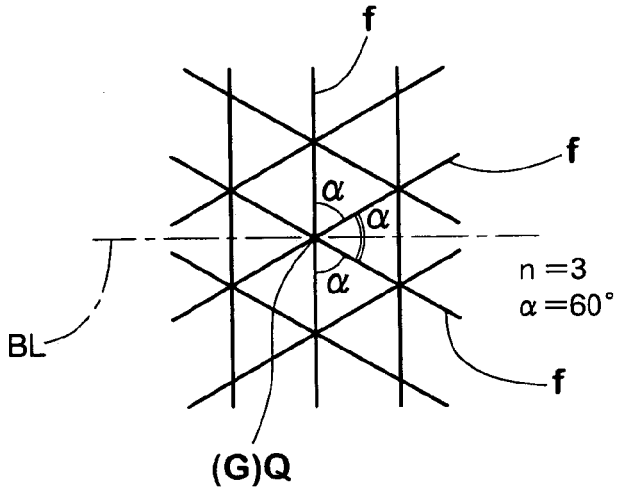
Figure 9C:
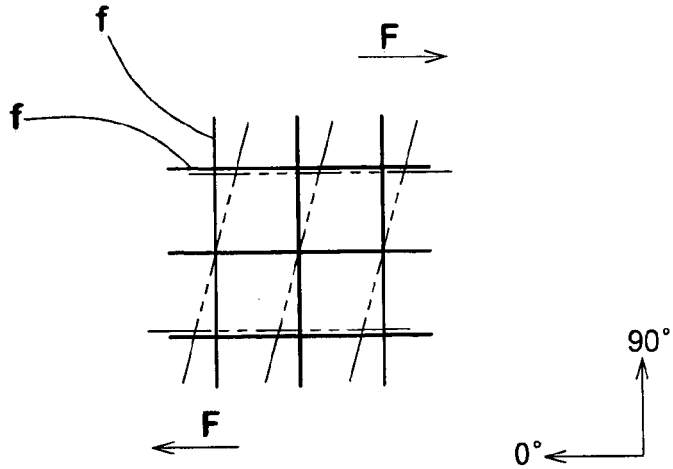
FIG. 9(C) is a schematic view showing a direction of conventional fibers.

The conventional FRP member has a grid-like reinforcing structure in which the fibers f are intersected at substantially 90 degrees, as shown in FIG. 9(C). However, the reinforcing structure mentioned above is easily deformed to a diamond shape by a shearing force F in a plane direction acting thereon at a time of striking a ball. On the contrary, the FRP member FR according to the present embodiment shown in FIG. 9(A) has a reinforcing structure in which the fibers f are allocated in a truss shape. Accordingly, the structure is hard to be deformed in comparison with the conventional grid-like structure. Therefore, according to the head 1 of the present invention, the deforming amount of the FRP member FR at a time of striking the ball is small, and it is possible to lower the energy loss at a time of striking the ball. Accordingly, the kinetic energy of the head can be efficiently transmitted to the ball and the carry of the ball is improved.

Further, since it is sufficient that the angle α at which the directions D1 to D3 of the fibers f mentioned above intersect is substantially (180/n) degrees. In other words, each fibers f extend in the direction which divides 360 degrees equally on the intersection Q. Accordingly, it is not necessary that it completely coincide with this value. In other words, the measured angle α can be allowed to have a dispersion of ±(36/n) degrees with respect to the value (180/n) degrees. It is particularly desirable that the measured angle α is preferably included within a range of the dispersion of ±(18/n) degrees with respect to the value (180/n) degrees. Further, taking a curved surface of the crown portion 4 into consideration, it is sufficient that the angle α mentioned above is satisfied at the position of the head gravity point G in a plan view under the standard condition.

Further, in the unidirectional plies 12A to 12C, the matrix resin part of each of them is integrally formed with each other on the basis of various formations mentioned below. However, since the fibers f remain, it is possible to specify the kind number of the unidirectional plies and the angle of each of the fibers f on the basis of the completed head 1.

Further, the angle θ of the fiber orientations of the first to third unidirectional plies 12A to 12C and the head longitudinal direction BL is not particularly limited. However, the following aspects can be considered about a relative relation between the fibers f and the line BL.

First, the FRP member FR according to an embodiment in FIG. 9(A) includes at least one 0 degree direction ply 12B. Accordingly, the fiber f in the direction D2 mentioned above directly increases a rigidity in the head longitudinal direction in which the deformation becomes largest at a time of striking the ball. Therefore, the FRP member FR according to the embodiment can further improve a strength against the deformation, and further securely reduce an energy loss.

Further, as the other embodiment, as shown in FIG. 9(B), there is a case that the unidirectional plies does not include any 0 degree direction plies 12B. In this embodiment, the unidirectional plies comprises only non 0 degree plies having the fibers f respectively forming angles of 30 degrees, 90 degrees and −30 degrees with respect to the head longitudinal direction BL. Therefore, there is no fibers f extending in parallel to the head longitudinal direction BL. Therefore, in comparison with the aspect in FIG. 9(A), the deformation amount at a time of striking the ball of the FRP member FR becomes relatively large, however, the deformation is smaller in comparison with the conventional structure.

Further, in the embodiment shown in FIG. 9(B), the club face 2 is inclined backward at a time of an impact of the ball and the apparent loft angle is increased, on the basis of an increase of the deflecting amount of the FRP member FR1 in the head longitudinal direction. This serves for increasing the striking angle of the ball. Further, a so-called gear effect in a vertical direction is generated in the ball, on the basis of an increase of the loft angle of the club face 2 at a time of the impact. This lowers a backspin amount of the ball. Accordingly, it is possible to obtain a preferable trajectory having a high striking angle and a small backspin. In the case that 0 degree direction ply 12B is not included in the unidirectional plies, it is desirable to employ an arrangement in which the intersecting angle α of the fibers f is uniformly divided by the head longitudinal direction line BL, as shown in FIG. 9(A).

Further, in the present embodiment, three kinds of unidirectional plies 12A to 12C are used every two plies. An order of the arrangement and the like are not particularly limited. However, as shown in FIG. 6, it is desirable that same kind of two prepreg plies are not directly laminated. Accordingly, a balance of strength is improved.

Further, the FRP member FR according to the present embodiment includes one cloth ply 13 serving as the other prepreg than the unidirectional plies 12A to 12C. The cloth prepreg 13 is woven in a direction in which the fibers f intersect. Accordingly, it can uniformly elongate, for example, at a time of applying a pressure from one side surface so as to elongate. This serves for smoothly deforming the prepreg along a cavity of a metal mold at a time of molding the FRP member FR in accordance with an internal pressure molding method mentioned below. Further, the cloth ply can inhibit the fibers of the unidirectional ply 12 arranged in an inner side thereof from largely opening. Accordingly, it is desirable to arrange one or two cloth prepreg plies 13 on an outermost side of the laminated body of the unidirectional plies 12A to 12C. In addition, it is possible to employ the cloth prepreg ply 13 in an innermost layer.

In the case of using the cloth prepreg 13, it is desirable that the fiber orientations θ with respect to the head longitudinal direction BL is not less than 30 degrees, and more preferable not less than 40 degrees. If the angle θ is less than 30 degrees, there is a tendency that the rigidity in the head longitudinal direction of the FRP member FR is increased, and a repulsion performance is lowered. In this case, since the cloth ply 13 according to this example is woven such that the fibers f intersect at 90 degrees, it is preferable that the upper limit of the angle θ is set to be not more than 60 degrees, more preferably not more than 50 degrees.

Further, with respect to the cloth ply 13, it is desirable that the fibers comprises the bundle body obtained by previously bundling a plurality of filaments. The cloth ply 13 is used for obtaining an improved formability. Accordingly, it is preferable to make the filament number of one bundle body smaller in comparison with the unidirectional plies 12A to 12C. In the cloth ply 13, it is desirable that the filament number of the fibers f included in one bundle body is preferably not less than 1 K, more preferably not less than 2 K, further preferably not less than 3 K, and particularly preferably not less than 4 K. Further, it is desirable that the upper limit is preferably not more than 12 K, more preferably not more than 10 K, and further preferably not more than 8 K.

Figure 10:
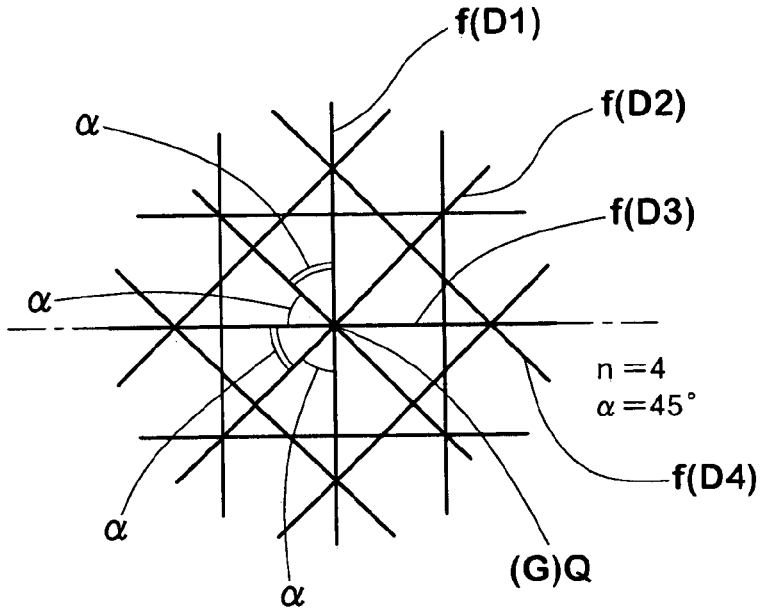
FIG. 10 is a schematic view showing a direction of fibers of unidirectional prepreg plies showing another embodiment according to the present invention.
Figure 11:
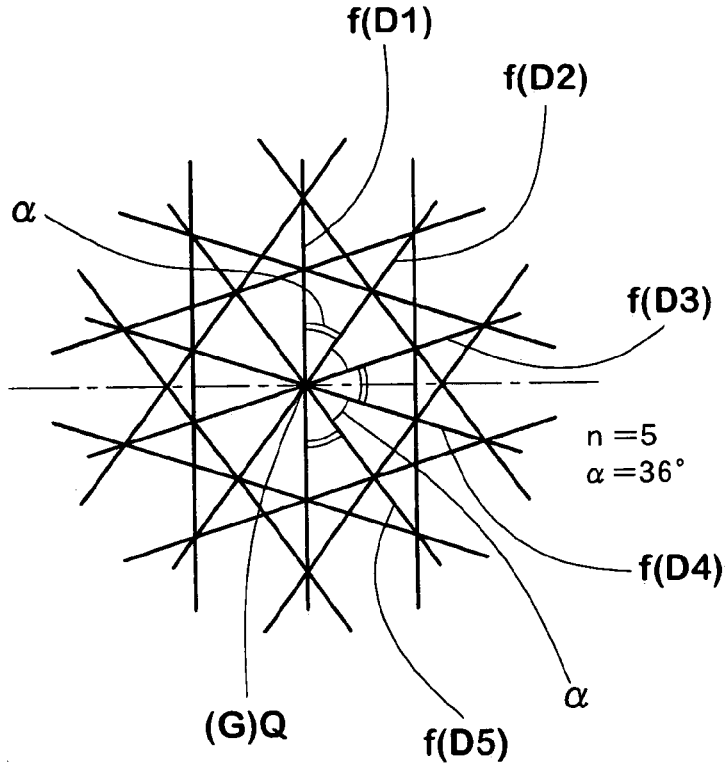
FIG. 11 is an schematic view showing a direction of fibers of unidirectional prepreg plies showing still another embodiment according to the present invention.

Further, in FIGS. 10 and 11, there is shown an intersecting state of the fibers f in the case that the kind number n is set to four and five, respectively. In an aspect shown in FIG. 10, the direction of the fibers f is D1 to D4, and the angle α is substantially 45 degrees. Further, in an aspect shown in FIG. 11, the direction of the fibers f is D1 to D5, and the angle α is substantially 36 degrees.

The FRP member FR can be molded according to various methods. For example, the FRP member FR can be formed by overlapping above prepreg plies 12A, 12B 12C and 13, and molding in a desired shape, for example, by applying heat and pressure within a mold. Further, the molded FRP member FR can be integrally firmly fixed to each of the receiving portions 8*b* and 9*b* of the opening O1 using an adhesive agent or the like.

Figure 12A:
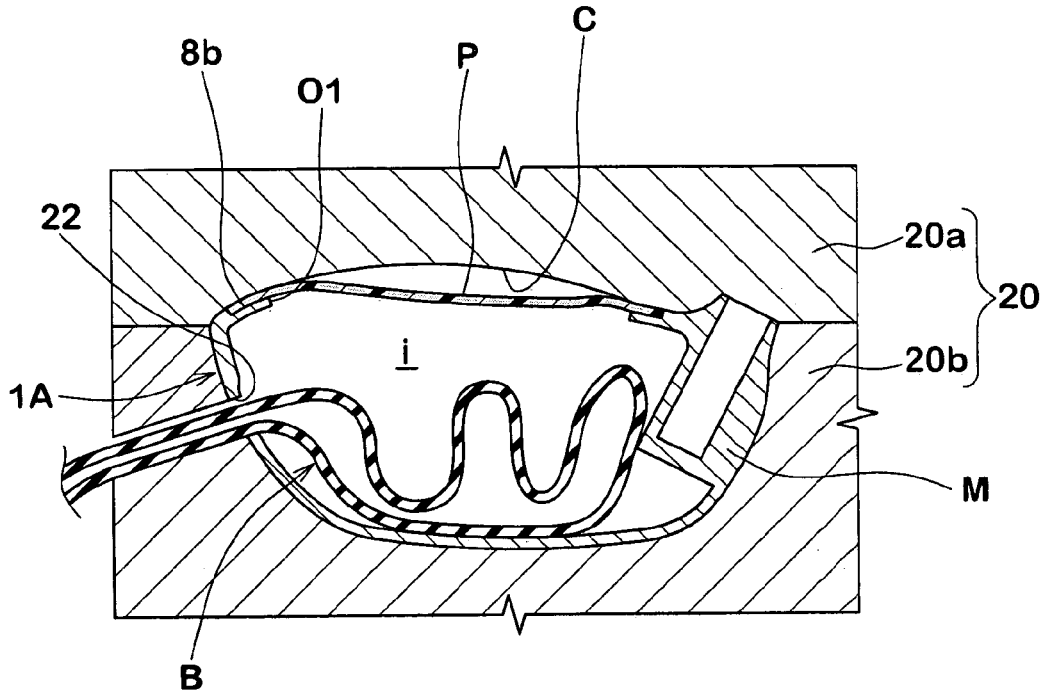
FIGS. 12(A) and 12(B) are cross sectional views showing a method of molding and concurrently integrating the FRP member.

Further, the FRP member FR can be molded by using a so-called internal pressure molding method, for example, as shown in FIG. 12. According to the internal pressure molding method, as shown in FIG. 12(A), there is executed a preliminary assembling step of assembling a head base body 1A by attaching the laminated body P of prepreg plies to the opening O1 of the metal member M so as to cover the opening O1. At this time, it is arranged such that the fibers f of the prepreg plies the angles mentioned above with respect to the head longitudinal BL. Further, in the case that, for example, a thermosetting type adhesive agent, a resin primer or the like is previously applied between the laminated body P and the receiving portions 8*b* and 9*b*, it is possible to prevent both the members from being displaced in the head base body 1A and it is possible to improve a molding accuracy.

The preliminarily assembled head base body 1A is set in a metal mold 20, for example, constituted by a pair of detachable upper mold 20*a* and lower mold 20*b*. The preliminary assembling step may be also executed, for example, in a state in which the metal member M is previously attached to the lower mold 20*b*. Further, it is desirable that the metal member M is previously provided with a through hole 22 communicating with a hollow portion i. In this example, the through hole 22 is provided in the side portion 6, however, the structure is not limited to this aspect. Further, a bladder B is inserted to the hollow portion i from the through hole 22. The bladder B is structured such as to freely expand and contract on the basis of incoming and outgoing of the pressurized and heated fluid.

Figure 12B:
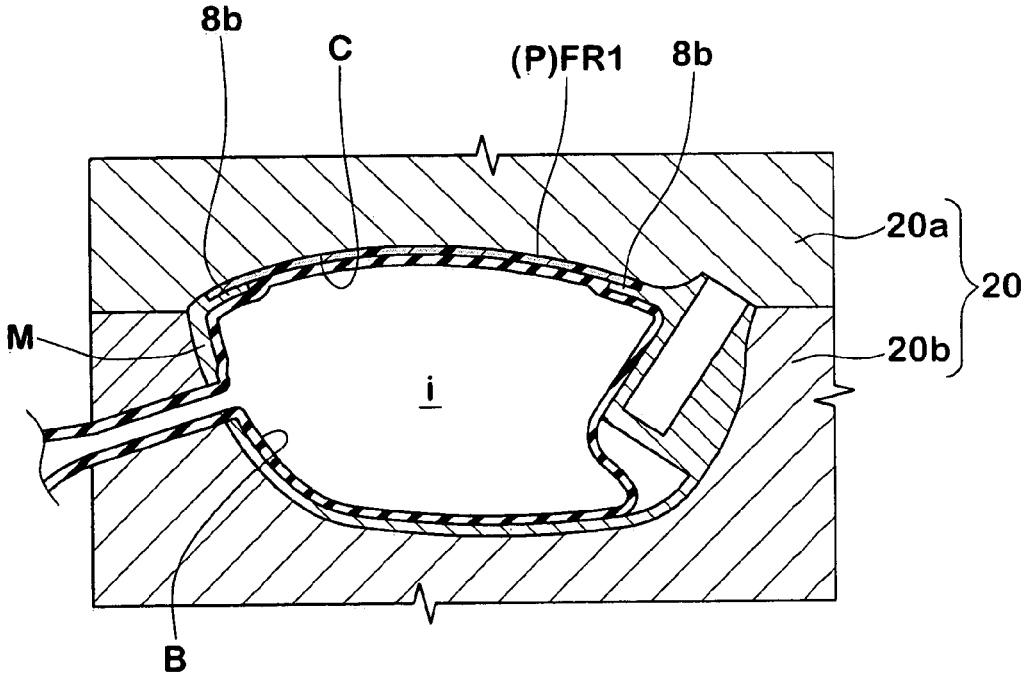

Thereafter, as shown in FIG. 12(B), the metal mold 20 is heated, and there is executed the curing step of expanding and deforming the bladder B in the hollow portion i. Accordingly, the laminated body P of the prepreg plies exposed to the heat and the pressure from the bladder B is deformed along a cavity C of the upper mold 20*a* and be molded to the desired crown side FRP member FR1, and a peripheral edge portion of the laminated body P is integrally adhered to the receiving portions 8*b* and 9*b*. When the cure is finished, the bladder B is deflated so as to be taken out from the through hole 22. The through hole 22 is closed by a badge, cover or the like provided with a trade name of the head, an ornamental pattern or the like, in the later step.

Figure 13A:
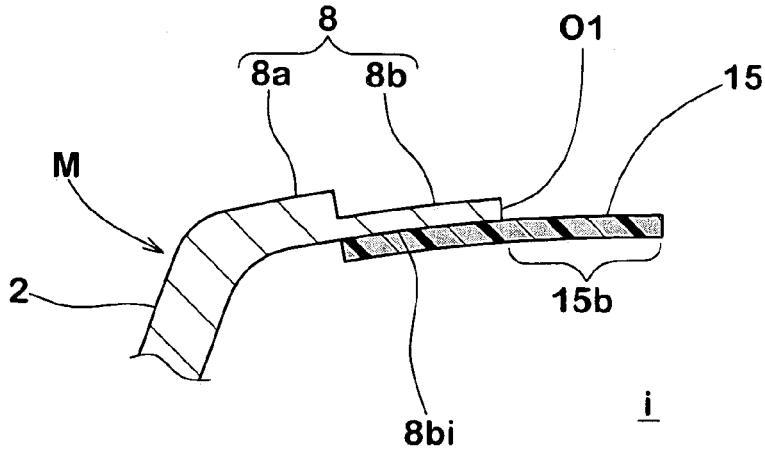
FIGS. 13(A), 13(B) and 13(C) are cross sectional views showing another method of molding and concurrently integrating the FRP member.

Further, in the case of using the internal pressure molding method, for example, as shown in FIG. 13(A), it is desirable to previously attach an auxiliary prepreg 15 to an inner surface 8*bi* directed in a side of the hollow portion i of the receiving portion 8*b* or 9*b* (the crown receiving portion 8*b* is exemplified in this example), in the opening O1 of the metal member M. The auxiliary prepreg 15 is attached to the inner surface 8*bi* of the crown receiving portion 8*b* with a protruding portion 15*b* protruding to the opening O1 side from an edge of the opening O1. Further, the auxiliary prepreg 15 is provided, for example, at least in a part of the periphery of the opening O1, however, it is desirable that the auxiliary prepreg 15 is annularly and continuously attached to the periphery of the opening O1.

Figure 13B:
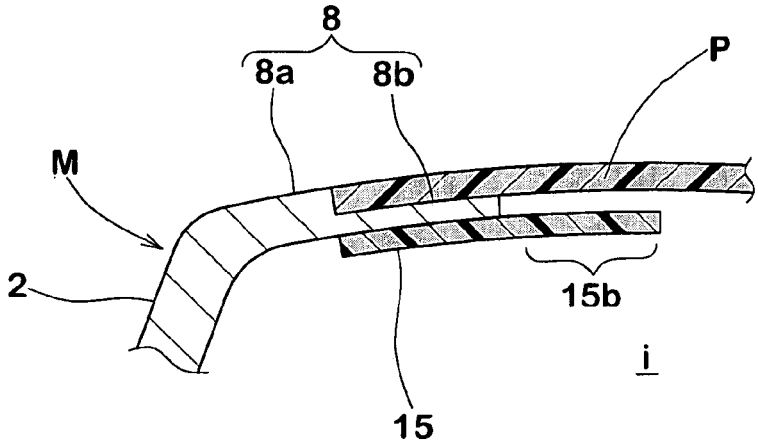
Figure 13C:
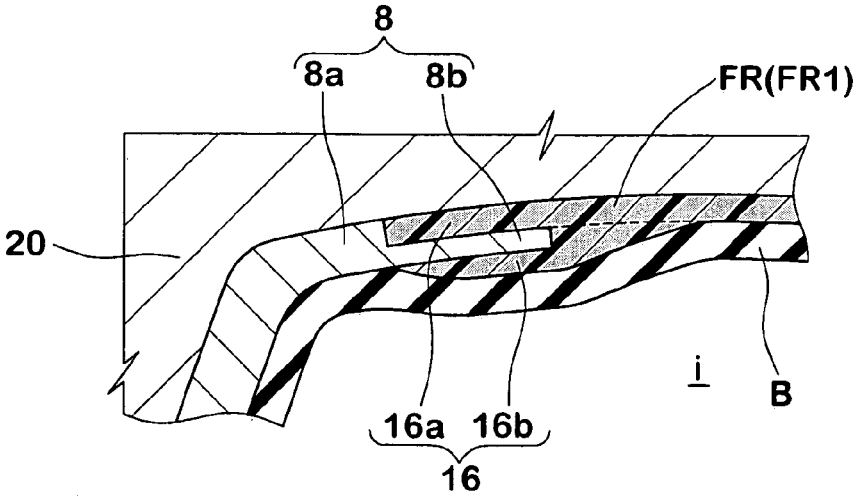

Next, as shown in FIG. 13(B), the laminated body P of the prepreg is attached to the crown receiving portion 8*b* so as to cover the opening O1 in the same manner as mentioned above, however, at this time, for example, it is possible to temporarily bond the protruding portion 15*b* of at least one auxiliary prepreg 15 to the inner surface of the laminated body P of the prepreg. Further, as shown in FIG. 13(C), the peripheral edge portion of the FRP member FR can be cured as a bifurcated portion 16 having an outer piece portion 16*a* extending along an outer surface of the crown receiving portion 8*b* and an inner piece portion 16*b* extending along an inner side of the receiving portion 8*b*, by executing the internal pressure molding within the metal mold 20. As mentioned above, it is possible to increase a bonding area between the FRP member FR and the metal member M according to a simple procedure and it is possible to manufacture the head 1 having a firm bonding strength, by including a step of previously arranging the auxiliary prepreg 15 having the protruding portion 15*b* on the inner side of the crown receiving portion 8*b* and/or the side receiving portion 9*b*, at a time of manufacturing the composite head.

In this case, since it is necessary that the auxiliary prepreg 15 is flexibly deformed by being in contact with the bladder B, it is desirable that an elastic modulus of the fiber f is not more than 350 GPa, more preferably not more than 300 GPa, further preferably not more than 250 GPa, and particularly preferably not more than 150 GPa, and it is desirable that an lower end thereof is not less than 50 GPa. Further, an angle of the fibers f of the auxiliary prepreg 15 is not particularly limited, however, it is preferable to set to about 30 to 60 degrees with respect to the head longitudinal direction line BL.

The head 1 according to the present embodiment can save the weight by using the FRP member FR1. Accordingly, it is possible to form the head at a volume preferably not less than 200 $cm^3$, more preferably not less than 300 $cm^3$, and further preferably not less than 380 $cm^3$. Therefore, it is possible to increase a comfort level when ready to hit the ball, and it is possible to increase a sweet spot area and a moment of inertia. In this case, an upper limit of the head volume is not particularly limited, however, it is desirable that it is not more than 500 $cm^3$, and on the basis of a rule regulation of R&A and USGA, it is preferable to restrict to be not more than 470 $cm^3$. Further, although not particularly limited, in the standard condition mentioned above, it is desirable that the moment of inertia around a perpendicular passing through the head gravity point is preferably not less than 2000 $g \cdot cm^2$, more preferably not less than 3000 $g \cdot cm^2$, and further preferably not less than 3500 $g \cdot cm^2$. Further, in the standard condition mentioned above, it is desirable that the moment of inertia around a horizontal axis in the toe and heel direction passing through the head gravity point is not less than 1500 $g \cdot cm^2$, and more preferably not less than 2000 $g \cdot cm^2$.

The present invention suitably applied to metal wood-type hollow heads, but it is also possible to apply the invention to other types of club heads such as utility-type, iron-type, and patter-type.

Figure 14:
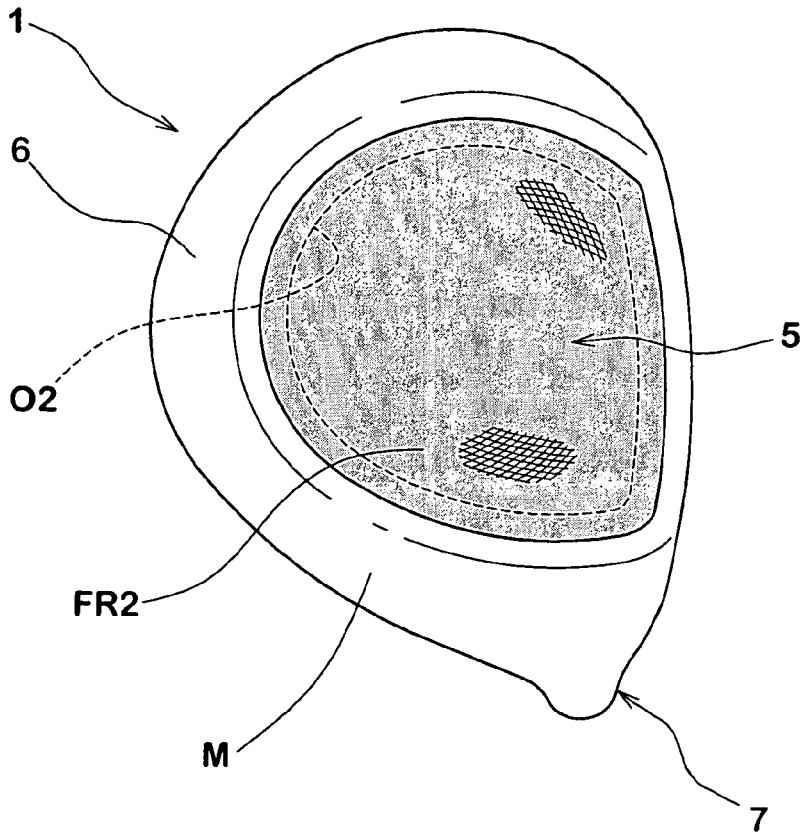
FIG. 14 is a bottom view showing another embodiment of the head.
Figure 15:
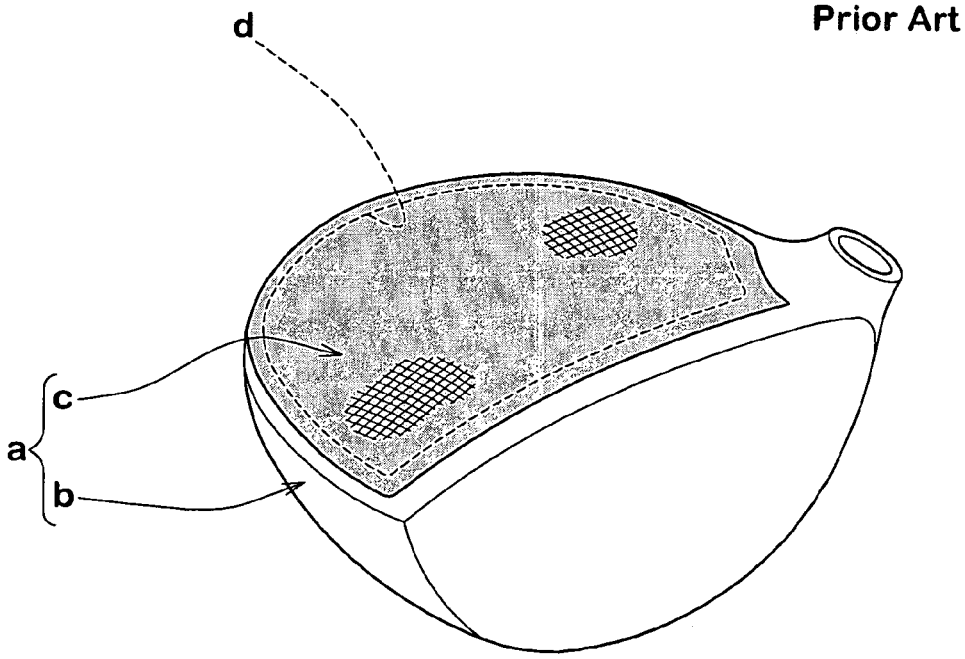
FIG. 15 is a perspective view showing a conventional head.
Figure 16A:
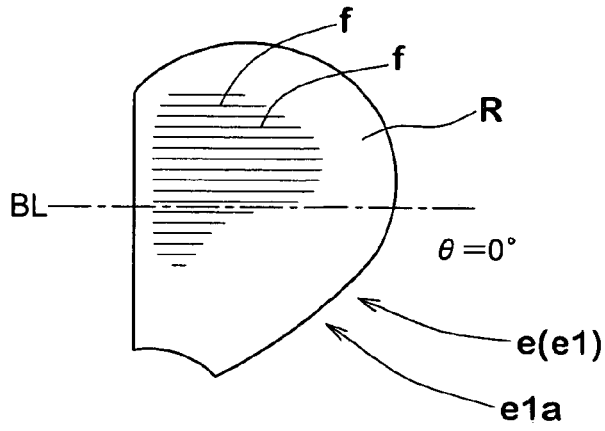
FIGS. 16(A), 16(B) and 16(C) are plan views showing a prepreg ply.
Figure 16B:
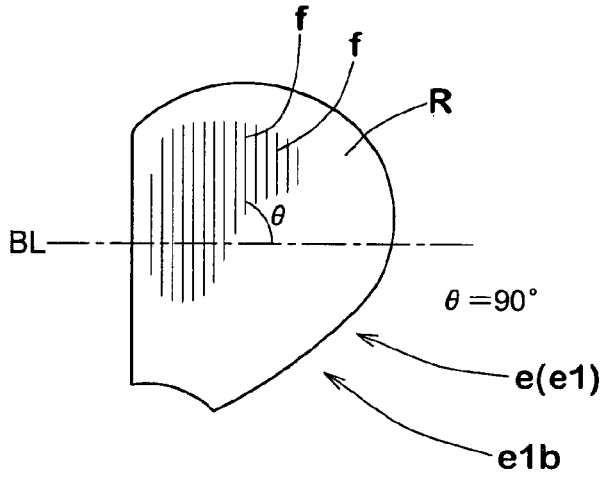
Figure 16C:
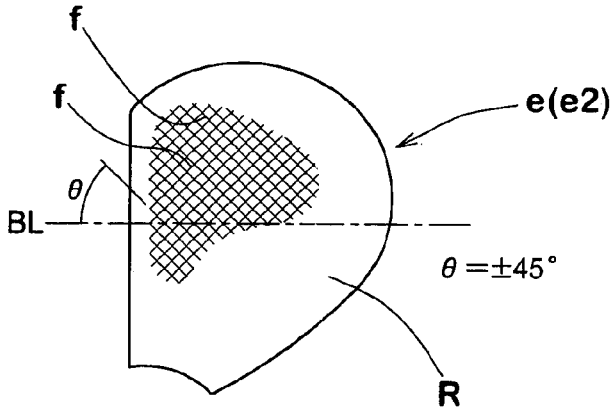

Further, in the embodiment mentioned above, there is shown the aspect that the FRP member made of the fiber reinforced resin is constituted by the crown side FRP member FR1, however, as shown in FIG. 14, an opening O2 is provided in the sole portion 5 together with the crown side FRP member FR1, and a sole side FRP member FR2 is provided there. In the latter embodiment, it is possible to further increase a moment of inertia around a vertical axis of the head. Further, in the present invention, for example, it goes without saying that, for example, a 45° direction prepreg or the like is included in the prepreg shown in FIG. 6.

Comparison Tests

Wood-type golf club heads having the same outer shapes shown in FIG. 1 and a head volume of 420 cc and specifications shown in Table 1 were made and tested for the durability and the rebound performance.

In each of the heads, the ratio (S1/S) between the area S1 of the opening and the head area S is set to 0.40. Shapes of the metal member and the FRP member are shown in FIGS. 1 to 4. Further, the specification of the prepreg (except the auxiliary prepreg) of the FRP member is as shown in Table 1. Further, all the fibers of the prepreg are made of a carbon fiber having an elastic modulus in tension of 235 GPa. The metal member is unified in shape by applying an NC process to the opening after being integrally cast by using Ti-6Al-4V for doing away with the dispersion.

Rebound Performance Test:

The restitution coefficient of the face portion was obtained according to the "Procedure for Measuring the Velocity Ratio of a Club Head for Conformance to Rule 4-1e, Appendix II, Revision 2 (Feb. 8, 1999), United States Golf Association". The test results are shown in Table 1, wherein the larger the value, the better the rebound performance.

Durability Test:

The club heads were attached to identical FRP shafts ("MP-200" SRI Sports., Ltd.) to make 45-inch wood clubs. Each club was attached to a swing robot and hit golf balls repeatedly at a head speed of 51 m/s. The number of hits until the ball striking face was damaged was counted and shown in Table 1. If there is no damage after 3000 hits, the head was appraised as passable and indicated as "Ok" in Table 1.

TABLE 1

| | | Conventional Example 1 | | | | Conventional Example 2 | | | | Example 1 | | | |
|---|---|---|---|---|---|---|---|---|---|---|---|---|---|
| | | Prepreg kind | Filament number of one bundle body | Fiber orientation θ [deg] | Thickness [mm] | Prepreg kind | Filament number of one bundle body | Fiber orientation θ [deg] | Thickness [mm] | Prepreg kind | Filament number of one bundle body | Fiber orientation θ [deg] | Thickness [mm] |
| Specification of prepreg laminated body | Layer 1 (outermost layer) | Cloth | 6K | 0/90 | 0.20 | Cloth | 6K | −45/45 | 0.20 | Cloth | 6K | 0/90 | 0.20 |
| | Layer 2 | UD | 24K | 0 | 0.15 | UD | 24K | −45 | 0.15 | UD | 24K | −60 | 0.10 |
| | Layer 3 | UD | 24K | 90 | 0.15 | UD | 24K | 45 | 0.15 | UD | 24K | 0 | 0.10 |
| | Layer 4 | UD | 24K | 0 | 0.15 | UD | 24K | −45 | 0.15 | UD | 24K | 60 | 0.10 |
| | Layer 5 | UD | 24K | 90 | 0.15 | UD | 24K | 45 | 0.15 | UD | 24K | −60 | 0.10 |
| | Layer 6 | — | — | — | — | — | — | — | — | UD | 24K | 0 | 0.10 |
| | Layer 7 | — | — | — | — | — | — | — | — | UD | 24K | 60 | 0.10 |
| | Layer 8 | — | — | — | — | — | — | — | — | — | — | — | — |
| | Layer 9 | — | — | — | — | — | — | — | — | — | — | — | — |
| Test result | Restitution coefficient | 0.825 | | | | 0.825 | | | | 0.835 | | | |
| | Durability performance | OK | | | | OK | | | | OK | | | |

| | | Example 2 | | | | Example 3 | | | | Example 4 | | | |
|---|---|---|---|---|---|---|---|---|---|---|---|---|---|
| | | Prepreg kind | Filament number of one bundle body | Fiber orientation θ [deg] | Thickness [mm] | Prepreg kind | Filament number of one bundle body | Fiber orientation θ [deg] | Thickness [mm] | Prepreg kind | Filament number of one bundle body | Fiber orientation θ [deg] | Thickness [mm] |

TABLE 1-continued

| | | | | | | | | | | | | | |
|---|---|---|---|---|---|---|---|---|---|---|---|---|---|
| Specification of prepreg laminated body | Layer 1 (outermost layer) | Cloth | 6K | 0/90 | 0.20 | Cloth | 6K | 0/90 | 0.20 | Cloth | 6K | 0/90 | 0.2 |
| | Layer 2 | UD | 12K | −45 | 0.075 | UD | 12K | −60 | 0.075 | UD | 24K | −60 | 0.2 |
| | Layer 3 | UD | 12K | 0 | 0.075 | UD | 12K | 0 | 0.075 | UD | 24K | 0 | 0.2 |
| | Layer 4 | UD | 12K | 45 | 0.075 | UD | 12K | 60 | 0.075 | UD | 24K | 60 | 0.2 |
| | Layer 5 | UD | 12K | 90 | 0.075 | UD | 12K | −60 | 0.075 | — | — | — | — |
| | Layer 6 | UD | 12K | −45 | 0.075 | UD | 12K | 0 | 0.075 | — | — | — | — |
| | Layer 7 | UD | 12K | 0 | 0.075 | UD | 12K | 60 | 0.075 | — | — | — | — |
| | Layer 8 | UD | 12K | 45 | 0.075 | — | — | — | — | — | — | — | — |
| | Layer 9 | UD | 12K | 90 | 0.075 | — | — | — | — | — | — | — | — |
| Test result | Restitution coefficient | 0.838 | | | | 0.833 | | | | 0.831 | | | |
| | Durability performance | OK | | | | OK | | | | OK | | | |

| | | Example 5 | | | | Comparative Example 1 | | | | Comparative Example 2 | | | |
|---|---|---|---|---|---|---|---|---|---|---|---|---|---|
| | | Prepreg kind | Filament number of one bundle body | Fiber orientation θ [deg] | Thickness [mm] | Prepreg kind | Filament number of one bundle body | Fiber orientation θ [deg] | Thickness [mm] | Prepreg kind | Filament number of one bundle body | Fiber orientation θ [deg] | Thickness [mm] |
| Specification of prepreg laminated body | Layer 1 (outermost layer) | UD | 12K | −60 | 0.075 | Cloth | 6K | 0/90 | 0.20 | Cloth | 6K | 0/90 | 0.20 |
| | Layer 2 | UD | 12K | 0 | 0.075 | UD | 24K | −30 | 0.10 | UD | 24K | −45 | 0.10 |
| | Layer 3 | UD | 12K | 60 | 0.075 | UD | 24K | 0 | 0.10 | UD | 24K | 0 | 0.10 |
| | Layer 4 | UD | 12K | −60 | 0.075 | UD | 24K | 30 | 0.10 | UD | 24K | 45 | 0.10 |
| | Layer 5 | UD | 12K | 0 | 0.075 | UD | 24K | −30 | 0.10 | UD | 24K | −45 | 0.10 |
| | Layer 6 | UD | 12K | 60 | 0.075 | UD | 24K | −0 | 0.10 | UD | 24K | 0 | 0.10 |
| | Layer 7 | — | — | — | — | UD | 24K | 30 | 0.10 | UD | 24K | 45 | 0.10 |
| | Layer 8 | — | — | — | — | — | — | — | — | — | — | — | — |
| | Layer 9 | — | — | — | — | — | — | — | — | — | — | — | — |
| Test result | Restitution coefficient | 0.835 | | | | 0.822 | | | | 0.828 | | | |
| | Durability performance | OK | | | | X (Break at 1670 hits) | | | | OK | | | |

* Cloth: Cloth ply
* UD: Unidirectional ply

From the test results, it was confirmed that the heads in accordance with the examples have high rebound performance without spoiling the durability. Accordingly, the heads can increase the driving distance of a hit ball.

What is claimed is:

1. A hollow golf club head comprising:

a metal member made of at least one kind of metal material having at least one opening in a crown portion thereof; and a FRP member made of a fiber reinforced resin attached to the metal member so as to cover the opening, the fiber reinforced resin formed from a plurality of prepreg plies each having a magnitude covering the opening, and the prepreg plies comprising a plurality of unidirectional plies each having fibers aligned along an unidirection, wherein the unidirectional plies comprise at least "n" (in this case, "n" is an integral number not less than 3 and not more than 6) kinds of plies each having fibers aligned in different directions, the "n" kinds plies being used in successive unidirectional plies, the unidirectional plies are laminated without directly laminating the same kind of two plies, and in a standard condition of the club head being grounded on a horizontal plane and oriented at its lie angle and its loft angle, the directions of the fibers of the "n" kind of unidirectional plies, in plan view, intersect at an angle (180/n) degrees obtained by substantially dividing 180 degrees by the integral number n in the crown portion.

2. The golf club head according to claim 1, wherein the prepreg plies comprise at least one cloth ply having woven fibers extending in two directions and arranged on an outermost side thereof.

3. The golf club head according to claim 1, wherein the unidirectional plies comprise at least one 0° direction ply having a fiber orientation of 0° with respect to a head longitudinal direction parallel to a normal line drawn from a head gravity point to a club face, in a plan view in the standard condition.

4. The golf club head according to claim 1, wherein the unidirectional plies comprise only non 0° direction plies having a fiber orientation of larger than 0° or smaller than 0° with respect to a head longitudinal direction parallel to a normal line drawn from a head gravity point to a club face, in a plan view in the standard condition.

5. A hollow golf club head comprising:

a metal member made of at least one kind of metal material having at least one opening being provided astride a crown portion and a side portion of the club head; and a FRP member made of a fiber reinforced resin attached to the metal member so as to cover the opening, the FRP member comprising a main part forming a part of the crown portion and a side part folded from the main part to the side portion to form a part of the side portion of the club head, the fiber reinforced resin formed from a plurality of prepreg plies each having a magnitude covering the opening, each prepreg ply being provided with at least one slit to make it easy to form the side part by folding, and the prepreg plies comprising a plurality of unidirectional plies each having fibers aligned along an unidirection, wherein the unidirectional plies comprise at least "n" (in this case, "n" is an integral number not less than 3 and not more than 6) kinds of plies each having fibers aligned in different directions, in a standard condition of the club head being grounded on a horizontal plane and oriented at its lie angle and its loft angle, the directions of the fibers of the "n" kind of unidirectional plies, in plan view, intersect at an angle (180/n) degrees obtained by substantially dividing 180 degrees by the integral number n in the crown portion.

6. The golf club head according to claim 5, wherein the prepreg plies comprise at least one cloth ply having woven fibers extending in two directions and arranged on an outermost side thereof.

7. The golf club head according to claim 5, wherein the unidirectional plies comprise at least one 0° direction ply having a fiber orientation of 0 degree with respect to a head longitudinal direction parallel to a normal line drawn from a head gravity point to a club face, in a plan view in the standard condition.

8. The golf club head according to claim 5, wherein the unidirectional plies comprise only non 0° direction plies having a fiber orientation of larger than 0 degree or smaller than 0 degree with respect to a head longitudinal direction parallel to a normal line drawn from a head gravity point to a club face, in a plan view in the standard condition.

9. A hollow golf club head comprising:

a metal member made of at least one kind of metal material having at least one opening in a crown portion of the club head; and a FRP member made of a fiber reinforced resin attached to the metal member so as to cover the opening, the fiber reinforced resin formed from a plurality of prepreg plies each having a magnitude covering the opening, the prepreg plies comprising a plurality of unidirectional plies each having fibers aligned along an unidirection and at least one cloth ply having woven fibers extending in two directions and arranged on the outermost side, each fiber of each unidirectional ply being allocated by arranging bundle bodies each consisting of fiber filaments of from 6000 to 40000 bundled previously, and each fiber of the cloth ply being allocated by arranging bundle bodies each consisting of fiber filaments being smaller than that of the bundle body of the unidirectional ply, wherein the unidirectional plies comprise at least "n" (in this case, "n" is an integral number not less than 3 and not more than 6) kinds of plies each having fibers aligned in different directions, in a standard condition of the club head being grounded on a horizontal plane and oriented at its lie angle and its loft angle, the directions of the fibers of the "n" kind of unidirectional plies, in plan view, intersect at an angle (180/n) degrees obtained by substantially dividing 180 degrees by the integral number n in the crown portion.

10. The golf club head according to claim 9, wherein the unidirectional plies comprise at least one 0° direction ply having a fiber orientation of 0 degree with respect to a head longitudinal direction parallel to a normal line drawn from a head gravity point to a club face, in a plan view in the standard condition.

11. The golf club head according to claim 9, wherein the unidirectional plies comprise only non 0° direction plies having a fiber orientation of larger than 0 degree or smaller than 0 degree with respect to a head longitudinal direction parallel to a normal line drawn front a head gravity point to club face, in a plan view in the standard condition.

* * * * *